US007628693B2

(12) United States Patent
Thomas

(10) Patent No.: US 7,628,693 B2
(45) Date of Patent: Dec. 8, 2009

(54) WAGERING GAME WITH ADVANTAGEOUS SYMBOL METER

(75) Inventor: Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 382 days.

(21) Appl. No.: 11/186,472

(22) Filed: Jul. 21, 2005

(65) Prior Publication Data

US 2006/0025203 A1 Feb. 2, 2006

Related U.S. Application Data

(60) Provisional application No. 60/592,270, filed on Jul. 29, 2004.

(51) Int. Cl.
*A63F 9/24* (2006.01)

(52) U.S. Cl. ..... 463/20; 463/16; 463/25

(58) Field of Classification Search ..... 463/20, 463/18, 19, 25, 16, 17
See application file for complete search history.

(56) References Cited

U.S. PATENT DOCUMENTS

| | | | | |
|---|---|---|---|---|
| 5,766,074 | A | 6/1998 | Cannon et al. | 463/16 |
| 6,155,925 | A | 12/2000 | Giobbi et al. | 463/20 |
| 6,159,097 | A | 12/2000 | Gura | 463/20 |
| 6,159,098 | A | 12/2000 | Slomiany et al. | 463/25 |
| 6,174,233 | B1 | 1/2001 | Sunaga et al. | 463/20 |
| 6,254,481 | B1 | 7/2001 | Jaffe | 463/20 |
| 6,270,411 | B1 | 8/2001 | Gura et al. | 463/20 |
| 6,287,194 | B1 * | 9/2001 | Okada et al. | 463/16 |
| 6,319,124 | B1 | 11/2001 | Baerlocher et al. | 463/20 |
| 7,195,559 | B2 * | 3/2007 | Gilmore et al. | 463/20 |
| 2003/0087687 | A1 * | 5/2003 | Locke et al. | 463/20 |
| 2003/0125102 | A1 * | 7/2003 | Cannon | 463/20 |
| 2003/0157978 | A1 * | 8/2003 | Englman | 463/16 |
| 2004/0121833 | A1 * | 6/2004 | Mezen et al. | 463/16 |
| 2005/0054429 | A1 * | 3/2005 | Baerlocher et al. | 463/25 |
| 2005/0143164 | A1 * | 6/2005 | Duhamel et al. | 463/20 |
| 2005/0282613 | A1 * | 12/2005 | Pryzby et al. | 463/20 |

* cited by examiner

*Primary Examiner*—John M Hotaling, II
*Assistant Examiner*—Damon J. Pierce
(74) *Attorney, Agent, or Firm*—Nixon Peabody LLP

(57) ABSTRACT

A gaming terminal for playing a wagering game includes a display, a meter, and a controller. The controller is coupled to the display and is programmed to present on the display a randomly-selected outcome selected from a plurality of outcomes. The outcome is presented to a player in the form of an arrangement of symbols, at least one of the symbols being an advantageous symbol. The controller is further programmed to emphasize a corresponding meter symbol in the meter when the advantageous symbol has been displayed on the display.

19 Claims, 10 Drawing Sheets

WAGERING GAME WITH ADVANTAGEOUS SYMBOL METER

RELATED APPLICATIONS

This application is related to and claims priority to U.S. Provisional Patent Application Ser. No. 60/592,270 filed Jul. 29, 2004, titled "Wagering Game With Advantageous Symbol Meter," which is incorporated herein in its entirety.

FIELD OF THE INVENTION

The present invention relates generally to gaming terminals for playing a wagering game and, more particularly, to a gaming terminal displaying a meter for indicating a player's progress toward reaching an advantageous outcome.

BACKGROUND OF THE INVENTION

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines.

Consequently, shrewd operators strive to employ the most entertaining and exciting machines available because such machines attract frequent play and, hence, increase profitability to the operator. In the competitive gaming machine industry, there is a continuing need for gaming machine manufacturers to produce new types of games, or enhancements to existing games, which will attract frequent play by increasing the entertainment value and excitement associated with the game.

One concept that has been successfully employed to enhance the entertainment value of a game is that of a "secondary" or "bonus" game which may be played in conjunction with a "basic" game. The bonus game, which is entered upon the occurrence of a selected event such as a start-bonus outcome of the basic game, may comprise any type of game, either similar to or completely different from the basic game. Such a bonus game produces a significantly higher level of player excitement than the basic game because it provides a greater expectation of winning than the basic game.

One problem with current games is that they do not provide a player with visual anticipation during a start-bonus outcome of the basic game. Thus, in current games the player's visual sense is not fully enhanced during the period between the basic game and the bonus game. Instead of providing a climatic experience for the player, steadily building the player's expectation of reaching the bonus game, current games generally provide an almost immediate result informing the player that a bonus game has been triggered. These games, which show an almost immediate result of a bonus game trigger, fail to capitalize on the player's visual sense of anticipation and, consequently, fail to provide a more entertaining gaming experience.

In one type of games, sounds are used for creating anticipation in a player. For example, in one type of games the gaming machine makes a sound as each trigger symbol lands in the display area. The sound indicates to the player that a bonus game is getting closer. In another type of games, all the trigger symbols are animated for entertainment purposes, to increase the player's gaming experience, after all the reels have stopped. None of these two types of games fully succeed in enhancing the player's gaming anticipation such that the player can visually observe, with anticipation, how close a particular spin has come to a bonus game.

Therefore, a need exists for a gaming machine that will provide a solution to the problems discussed above.

SUMMARY OF THE INVENTION

A gaming terminal for playing a wagering game includes a display, a meter, and a controller. The controller is coupled to the display and is programmed to present on the display a randomly-selected outcome selected from a plurality of outcomes. The outcome is presented to a player in the form of an arrangement of symbols, at least one of the symbols being an advantageous symbol. The controller is further programmed to emphasize a corresponding meter symbol in the meter when the advantageous symbol has been displayed on the display.

In another aspect of the present invention, a method of conducting a wagering game includes displaying on a main display a symbol array corresponding to a randomly-selected outcome selected from a plurality of outcomes. The symbol array includes an advantageous symbol. The method further includes displaying a meter having a plurality of meter symbols. In response to displaying the advantageous symbol and prior to all symbols in the symbol array being displayed, a corresponding meter symbol is emphasized within the meter.

In an alternative aspect of the present invention, a gaming terminal for playing a wagering game includes at least one display for displaying at least one randomly-selected outcome selected from a plurality of outcomes in response to receiving a wager input from a player. A plurality of reels is displayed in the at least one display, wherein the reels have an arrangement of symbols for indicating the at least one outcome to the player. The arrangement of symbols includes a plurality of advantageous symbols. The gaming terminal further includes a meter that is displayed in the at least one display and has a plurality of meter symbols. Each of the meter symbols corresponds to one of the advantageous symbols. In response to a corresponding one of the advantageous symbols stopping on an active payline, one of the meter symbols is emphasized before all of the reels have stopped.

In an alternative aspect of the present invention, a method of conducting a wagering game includes rotating a plurality of symbol-bearing reels and stopping one of the symbol-bearing reels with an advantageous symbol aligned along an active payline for indicating a randomly-selected outcome to a player. The randomly-selected outcome is selected from a plurality of outcomes. The method further includes emphasizing a meter symbol of a meter before all of the symbol-bearing reels have stopped, wherein the meter is located in a region separate from the symbol-bearing reels.

In an alternative aspect of the present invention, a method of conducting a wagering game on a gaming terminal includes accepting a wager input for a wagering game and selecting at least one randomly-selected outcome for the wagering game in response to the wager input. The at least one randomly-selected outcome is selected from a plurality of outcomes. In response to stopping a reel to align an advantageous symbol along a payline, a counterpart symbol is emphasized in a meter for visually indicating to a player how close the wagering game is to reaching a winning outcome. The remaining ones of the plurality of reels are stopped to indicate the at least one outcome, and an award is provided according to a pay table if the at least one outcome is the winning outcome.

The above summary of the present invention is not intended to represent each embodiment, or every aspect, of the present invention. Additional features and benefits of the present invention are apparent from the detailed description, figures, and claims set forth below.

Figure 1:
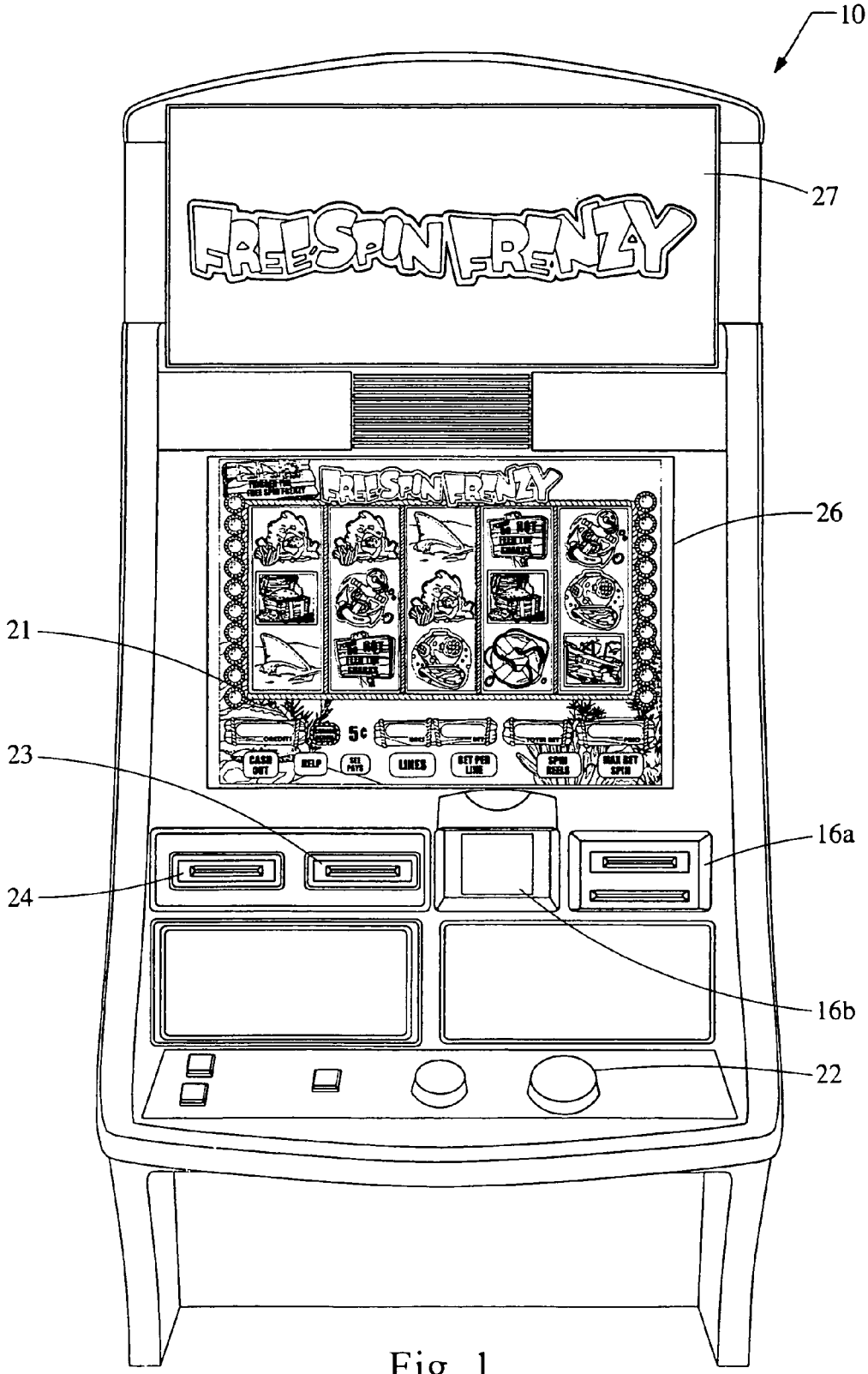
FIG. 1 illustrates a gaming terminal that is useful for displaying an advantageous outcome in accordance with the present invention.

While the invention is susceptible to various modifications and alternative forms, specific embodiments are shown by way of example in the drawings and are described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Referring to FIG. 1, a gaming terminal 10 is used in gaming establishments such as casinos. With regard to the present invention, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play a video casino game, such as blackjack, slots, keno, poker, etc.

The gaming terminal 10 includes input devices, such as a wager acceptor 16, a touch screen 21, a push-button panel 22, and a player-identification card reader 24. For output the gaming terminal 10 includes a main display 26 for displaying information about the basic wagering game. The main display 26 can also display information about a bonus wagering game and a progressive wagering game. The gaming terminal 10 also includes a secondary game display 27 for displaying the bonus wagering game, or for displaying award amounts of a progressive game. While these typical components found in the gaming terminal 10 are described below, it should be understood that numerous other elements may exist and may be used in any number of combinations to create various forms of a gaming terminal.

The wager acceptor 16 may be provided in many forms, individually or in combination. The wager acceptor 16 may include a coin slot acceptor or a note acceptor to input value to the gaming terminal 10. Or, the wager acceptor 16 may include a card-reading device for reading a card that has a recorded monetary value with which it is associated. The card may also authorize access to a central account, which can transfer money to the gaming terminal 10.

The push button panel 22 is typically offered, in addition to the touch screen 21, to provide players with an option on how to make their game selections. Alternatively, the push button panel 22 provides inputs for one aspect of operating the game, while the touch screen 21 allows for inputs needed for another aspect of operating the game.

The operation of the basic wagering game is displayed to the player on the main display 26. The main display 26 can also display the bonus game associated with the basic wagering game. The main display 26 may take the form of a cathode ray tube (CRT), a high resolution LCD, a plasma display, a LED, or any other type of video display suitable for use in the gaming terminal 10. As shown, the main display 26 includes the touch screen 21 overlaying the entire monitor (or a portion thereof) to allow players to make game-related selections. Alternatively, the gaming terminal 10 may have a number of mechanical reels to display the game outcome.

The player-identification card reader 24 allows for the identification of a player by reading a card with information indicating his or her true identity. Currently, the identification is used by casinos for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 24, which allows the casino's computers to register that player's wagering at the gaming terminal 10.

A player begins play of the basic wagering game by inserting a wager input into the wager input accepter 16 of the gaming terminal 10. A player can select play by either using the touch screen 21 or the push-button panel 22. The basic game consists of a plurality of symbols on reels that are displayed along a plurality of paylines, yielding a plurality of outcomes of the basic game. Such outcomes are randomly selected in response to the wagering input by the player. One of the plurality of randomly-selected outcomes is a start-bonus outcome, which can include any variations of symbols or symbol combinations triggering a bonus game.

Figure 2:
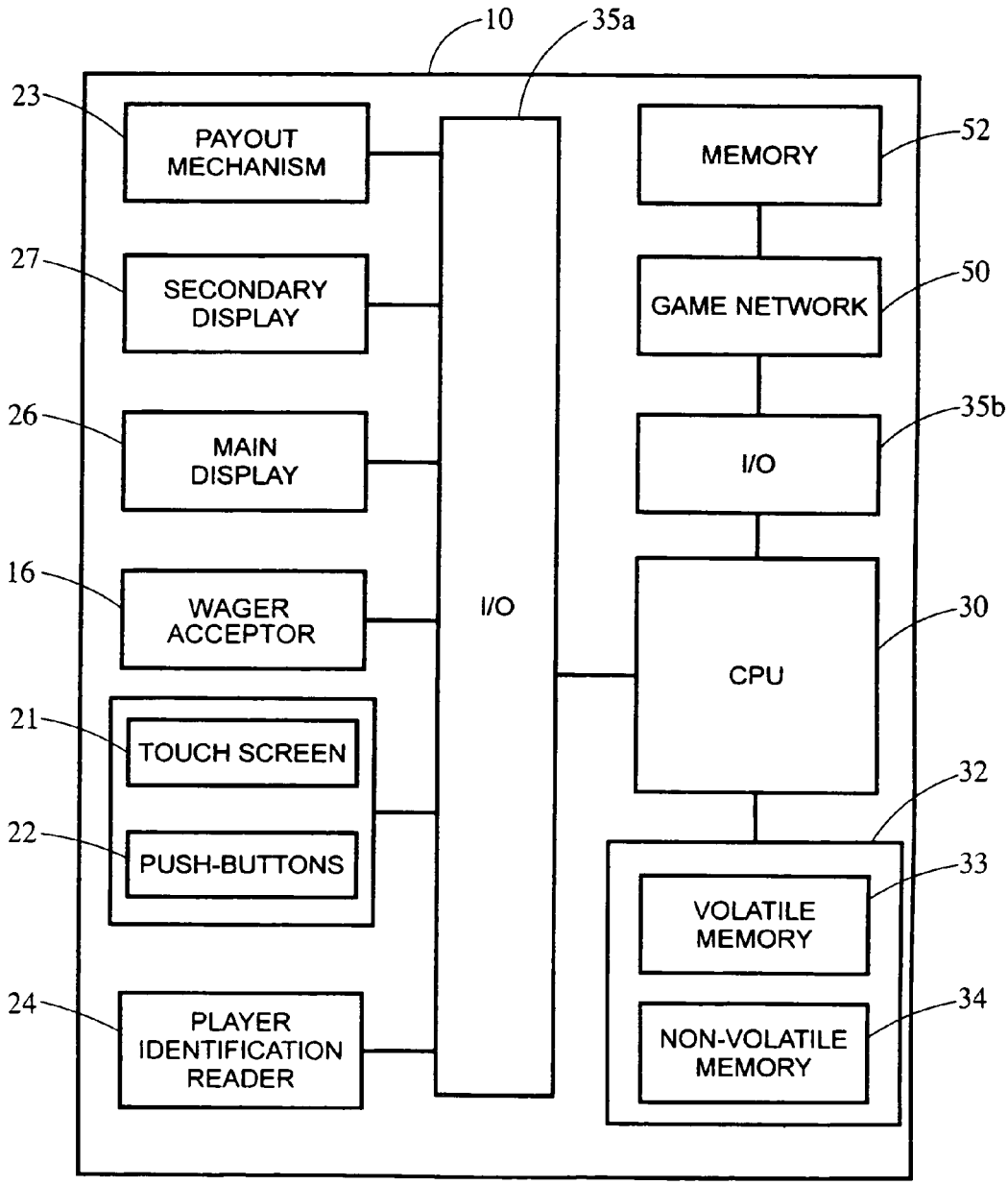
FIG. 2 illustrates a control system that is used in conjunction with the gaming terminal of FIG. 1.

As shown in FIG. 2, the various components of the gaming terminal 10 are controlled by a central processing unit (CPU) 30, also referred to as a processor (such as a microprocessor or microcontroller). To provide the gaming functions, the CPU 30 executes one or more game programs. The CPU 30 performs the random selection of an outcome from the plurality of outcomes of the wagering game. The CPU 30 is also coupled to or includes a system memory 32. The system memory 32 may comprise a volatile memory 33 (e.g., a random-access memory (RAM)) and a non-volatile memory 34 (e.g., an EEPROM). It should be appreciated that the CPU 30 may include one or more microprocessors. Similarly, the memory 32 may include multiple RAM and multiple program memories.

Communications between the peripheral components of the gaming terminal 10 and the CPU 30 occur through input/output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

The gaming terminal 10 is typically operated as part of a game control network 50 having control circuitry and memory devices. The gaming terminal 10 often has multiple serial ports, each port dedicated to providing data to a specific host computer system that performs a specific function (e.g., accounting system, player-tracking system, progressive game control system, etc). To set up a typical serial communication hardware link to the host system, the typical RS-232 point-to-point communication protocol that is often present in the gaming terminal 10 is converted to an RS-485 (or RS-485-type) master-slave protocol so as to take advantage of some of the advantages of the RS-485 capability (e.g., multi-drop capability that allows many gaming terminals 10 to communicate with the game control network 50). To perform this function, a custom interface board may be used by the gaming terminal 10 for each communication port in the gaming terminal 10. It should be noted that the gaming terminal 10 can initially be designed to be configured for a typical RS-485 protocol, instead of the typical RS-232 protocol. Further, the gaming terminal 10 may simply be designed for an Ethernet connection to the game control network 50.

Figure 3:
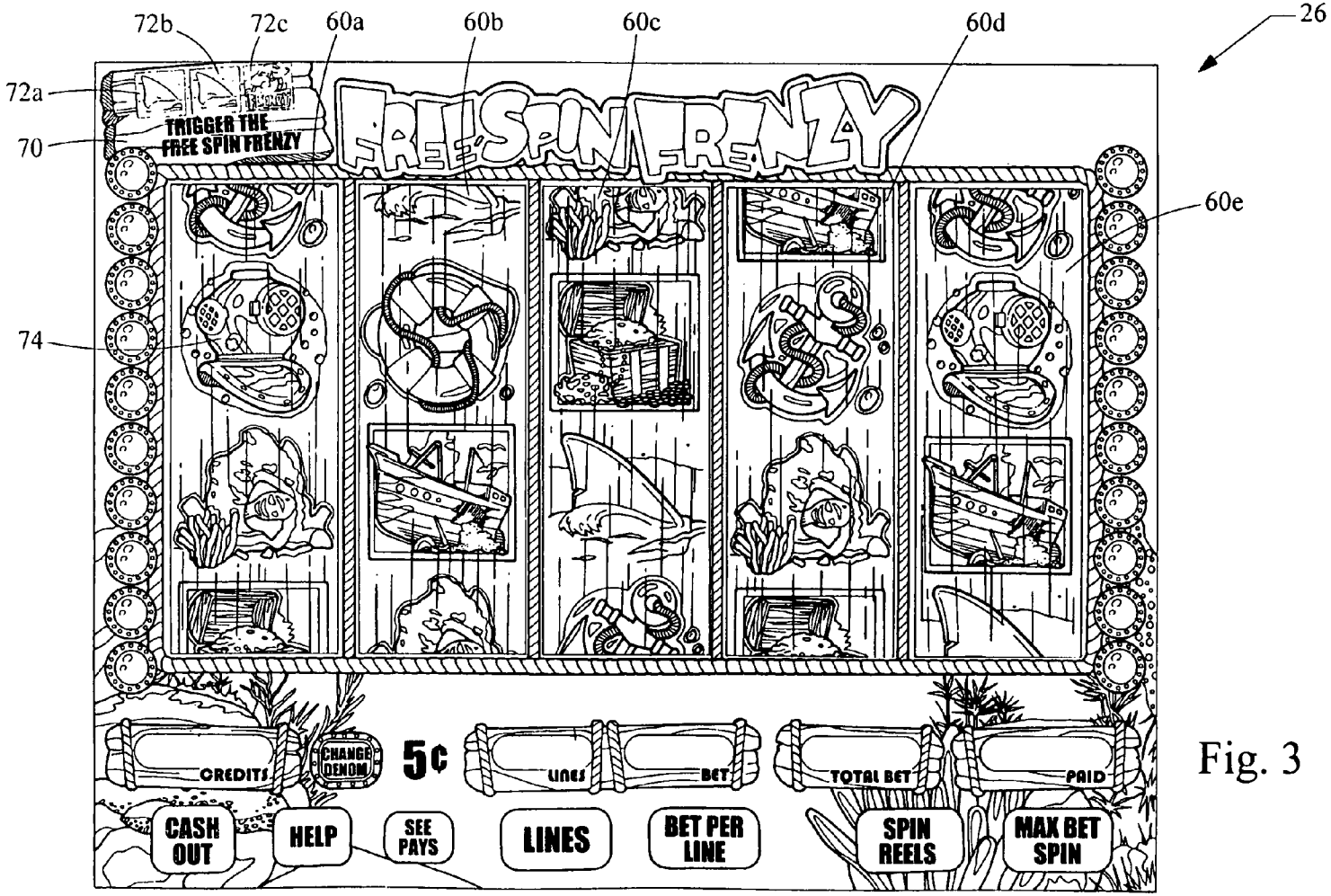
FIG. 3 illustrates a basic game screen having a meter and a plurality of spinning reels.

Referring now to FIG. 3, the main display 26 of the gaming terminal 10 shows a plurality of spinning reels 60*a*-60*e* (collectively referred to as reels 60), and a meter 70 having a plurality of meter symbols 72*a*-72*c* (collectively referred to as meter symbols 72). The reels 60 include an array of symbols 74. When an advantageous (or special) symbol 74 lands along an active payline, a counterpart meter symbol 72 is used to visually indicate to a player how close he or she is to obtaining a bonus game. The advantageous symbol is included in the array of symbols 74 that is displayed on reels 60.

Each time the player places a wager in a basic game and spins the reels 60, there is an inherent hope that one of the game outcomes is an advantageous outcome, such as a start-bonus outcome. The player knows that a start-bonus outcome results in a bonus game which potentially can greatly increase the player's winnings. In fact, there is a perception in some players that just obtaining a start-bonus outcome is a success in itself, regardless of whether the actual bonus game provides the player with additional winnings. To build a player's anticipation, which generally translates in a more entertaining gaming experience, it is desirable to provide the player with visual hints that the start-bonus outcome is getting closer.

In general, reels 60 stop in sequence, one at a time, starting with the leftmost reel 60*a* and ending with the rightmost reel 60*e*. As each one of the reels 60 stops, the player can see the symbol on the reel that has landed on the active payline. In general, the presence of one or more advantageous symbols 74 triggers a special event, such as the triggering of a bonus game or the awarding of a winning combination. For example a winning combination includes winning a progressive game, winning a jackpot, or winning a plurality of free spins. To enhance the player's anticipation that he or she is about to win a bonus game, the meter 70 visually indicates to the player how close an outcome of the basic game has come to an advantageous outcome, such as a bonus game.

Thus, as an advantageous symbol 74 lands in a predetermined position, which can be anywhere on the display 26, a counterpart meter symbol 72 is emphasized in some way to indicate that the player is a step closer to the desired bonus game. For example, the meter symbols 72 can be emphasized using illumination. Alternatively, the meter symbols 72 can be emphasized by changing colors, shades, shapes, or text included in the representation of the meter symbols 72. For example a meter symbol 72 can be emphasized using an oscillating or pulsating graphic, wherein the pace of the oscillation increases as more meter symbols 72 are emphasized. In other embodiments, emphasis of a visual nature can be coupled with audio emphasis.

An example of the present invention will be described below, in accordance with one embodiment of the present invention. Initially, the player plays the basic game and all the reels 60 are spinning, as shown in FIG. 3. The meter 70 is located above the reels 60, near the leftmost reel 60*a*, and includes three meter symbols 72. Each of the meter symbols 72 is displayed in a faded manner, such that the meter symbols 72 do not draw a player's attention. The first meter symbol 72*a* is a shark fin, the second meter symbol 72*b* is another shark fin, and the third meter symbol 72*c* is a "Frenzy" shark. If each of the meter symbols 72 is matched by a respective advantageous symbol 74, a bonus game may be awarded to the player. Thus, in one embodiment, two shark fin symbols 74 and a shark "Frenzy" symbol 74 must land anywhere in the display 26 for the player to win the bonus game. Alternatively, the advantageous symbols 74 must land in predetermined positions for triggering the advantageous outcome.

Figure 4:
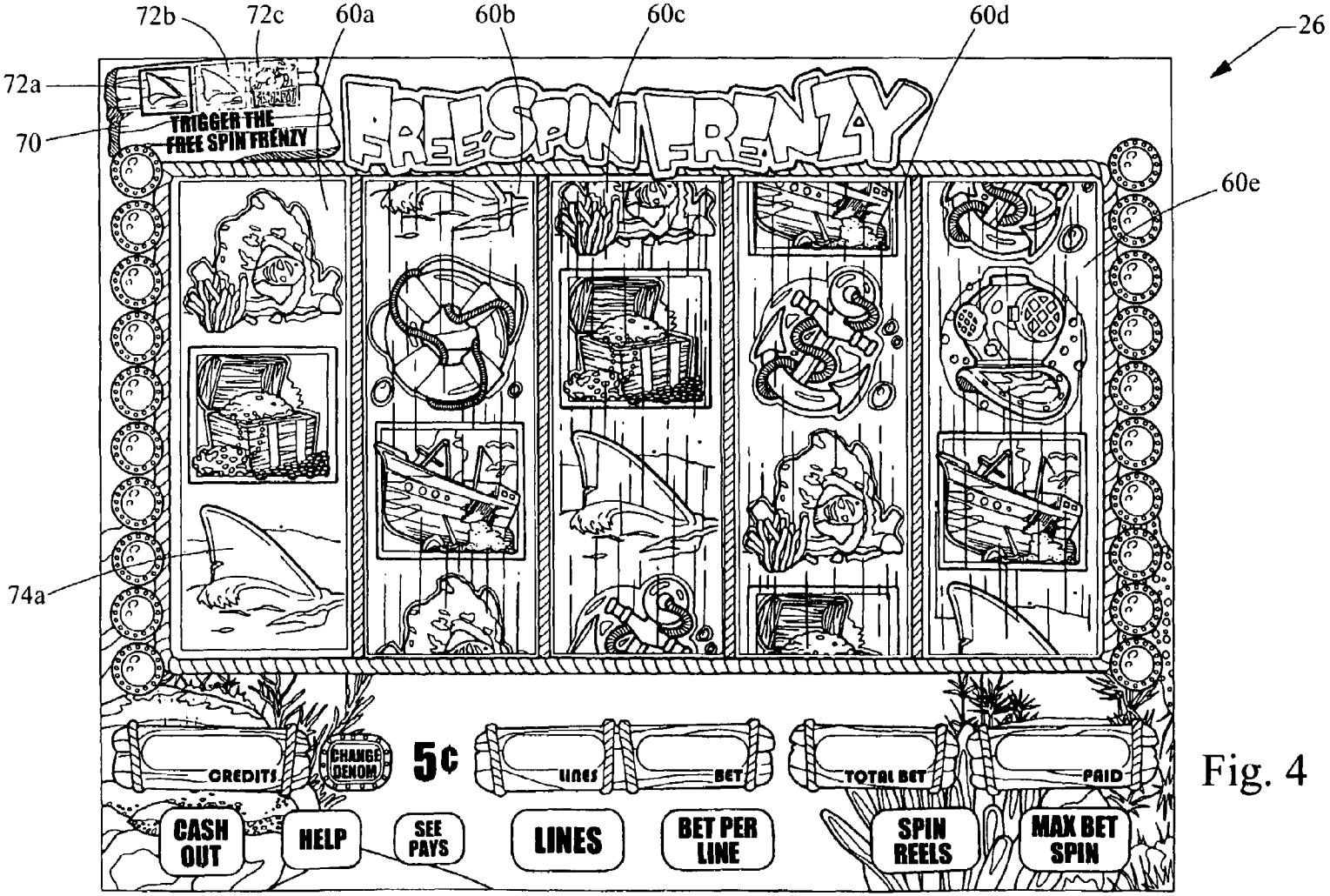
FIG. 4 illustrates the basic game screen of FIG. 3 showing one of the reels stopped.

Referring to FIG. 4, the leftmost reel 60*a* has stopped and an advantageous symbol 74*a* has landed in a bottom position. After the advantageous symbol 74*a* has landed, the CPU 30 is programmed to emphasize the counterpart meter symbol 72*a* in the meter 70. The meter symbol 72*a*, which shows a miniature version of the shark fin graphic of the advantageous symbol 74*a*, is now shown as being highlighted. Thus, the player is now aware that only two more advantageous symbols are required for winning a bonus or other advantageous outcome. Instead of having the player memorize or look up the symbol combination required for the bonus outcome, the meter 70 provides a simple and entertaining mode of indicating how close the player is to reaching the bonus outcome.

Figure 5:
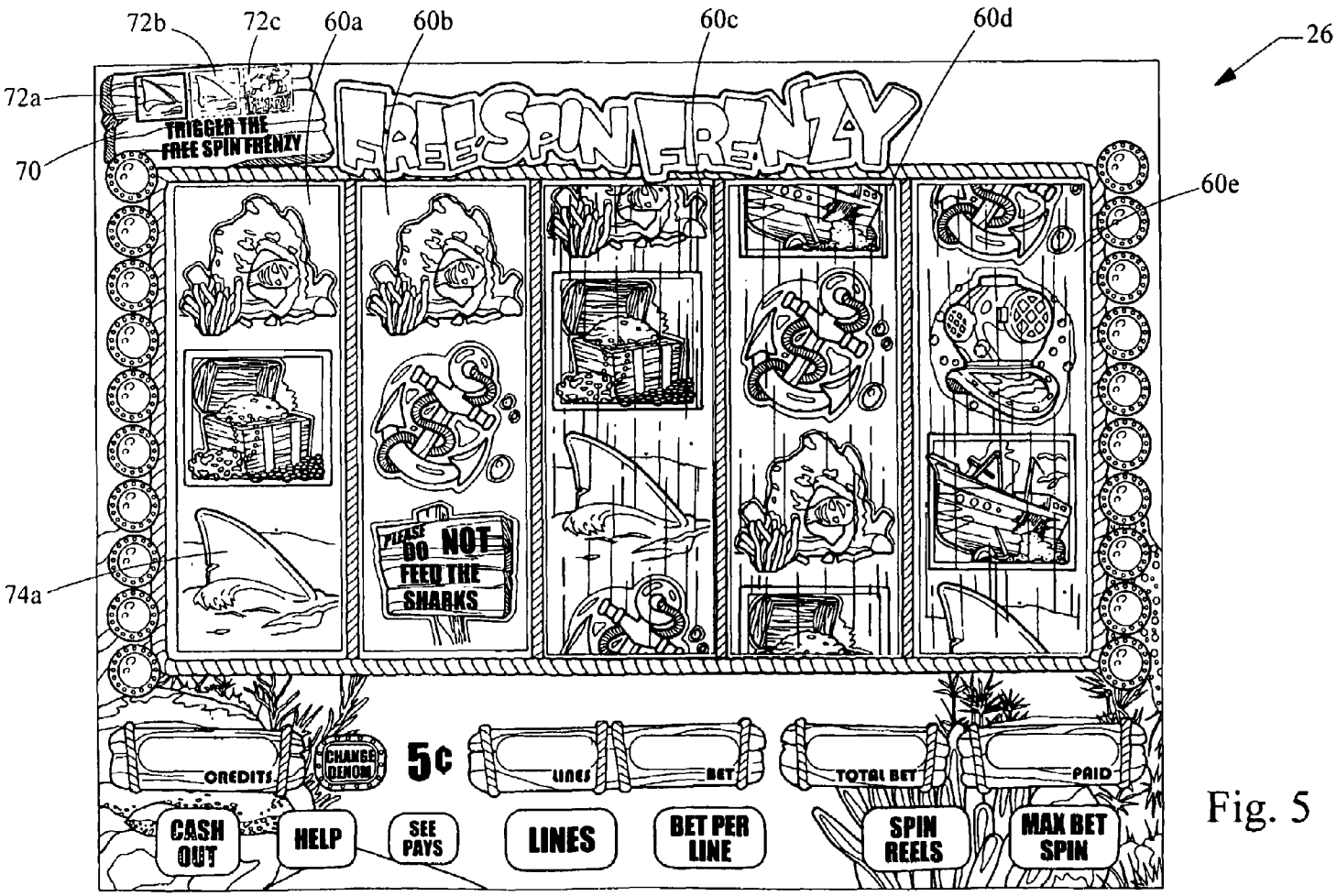
FIG. 5 illustrates the basic game screen of FIG. 3 showing two of the reels stopped.

Referring to FIG. 5, the adjacent reel 60*b* to the leftmost reel 60*a* has now stopped. No advantageous symbols have landed in any position of the reel 60*b*. Accordingly, no meter symbol 72 has been emphasized. The player, then, roots for additional advantageous symbols landing in the remaining three reels 60*c*-60*e*.

Figure 6:
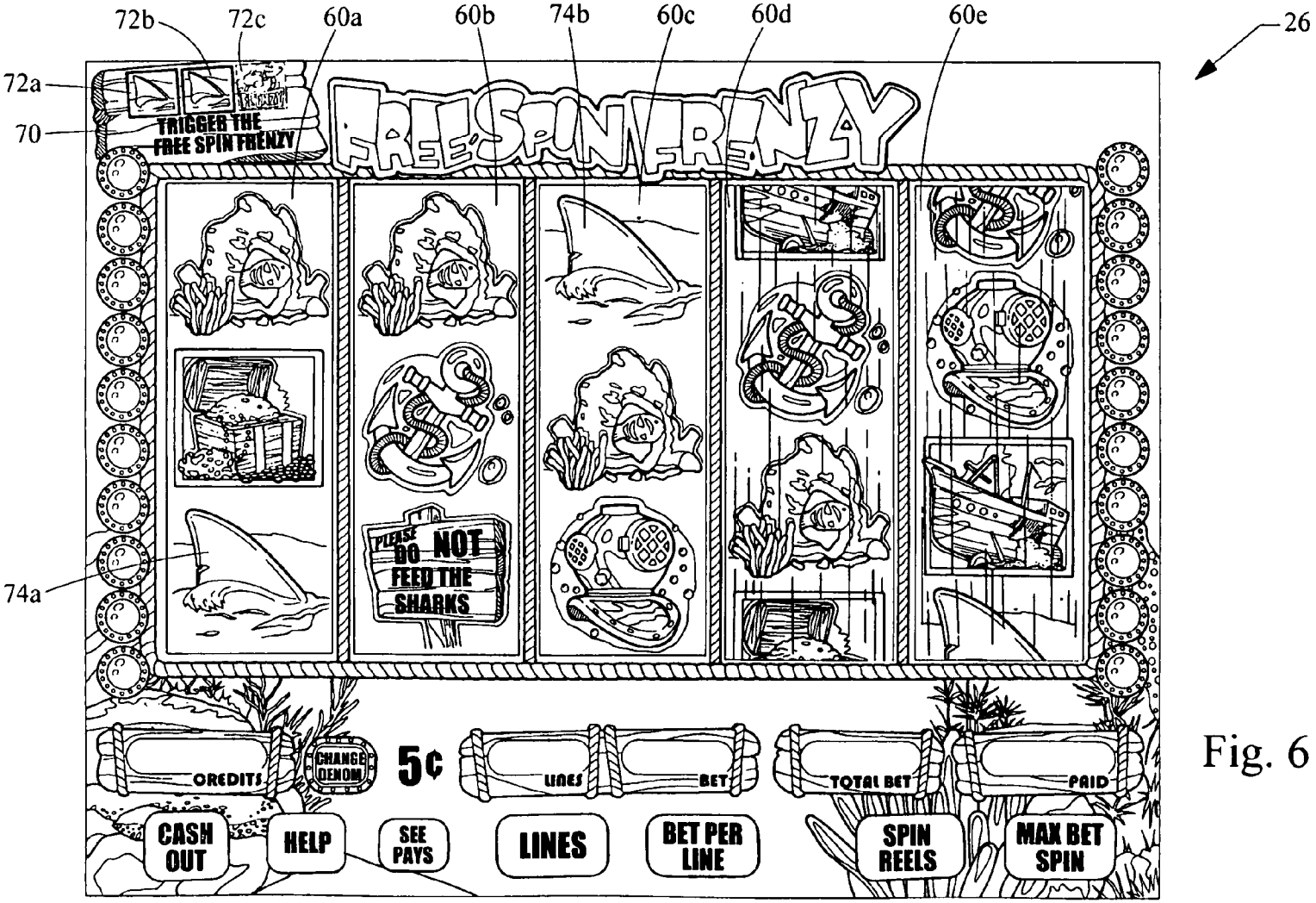
FIG. 6 illustrates the basic game screen of FIG. 3 showing three of the reels stopped.

Referring to FIG. 6, the center reel 60*c* has now stopped and an advantageous symbol 74*b* has landed in a top position. Consequently, the counterpart, or corresponding, meter symbol 72*b* is emphasized. The player is now aware, and more excited, that only one additional advantageous symbol is required for winning the advantageous outcome.

Figure 7:
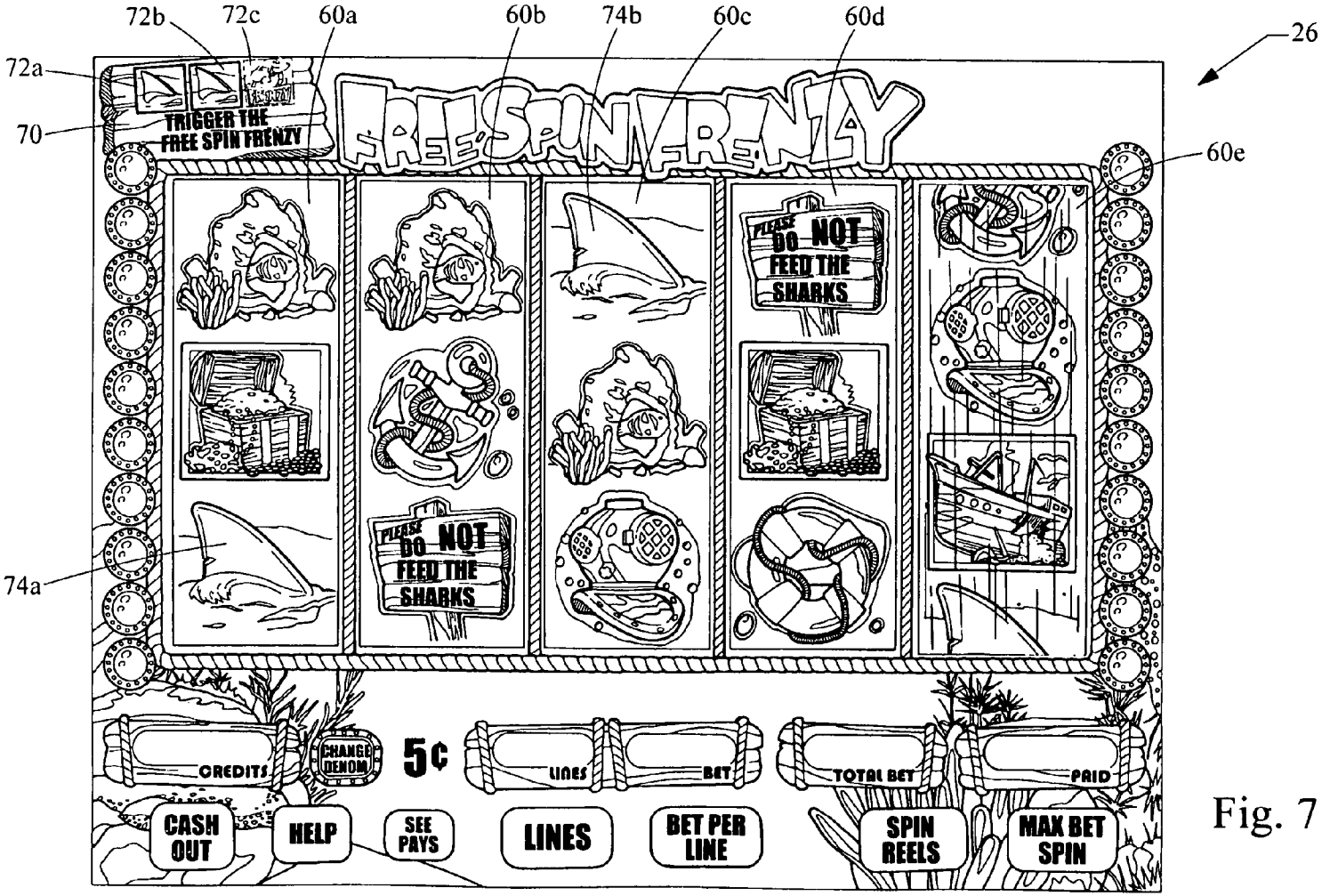
FIG. 7 illustrates the basic game screen of FIG. 3 showing four of the reels stopped.
Figure 8:
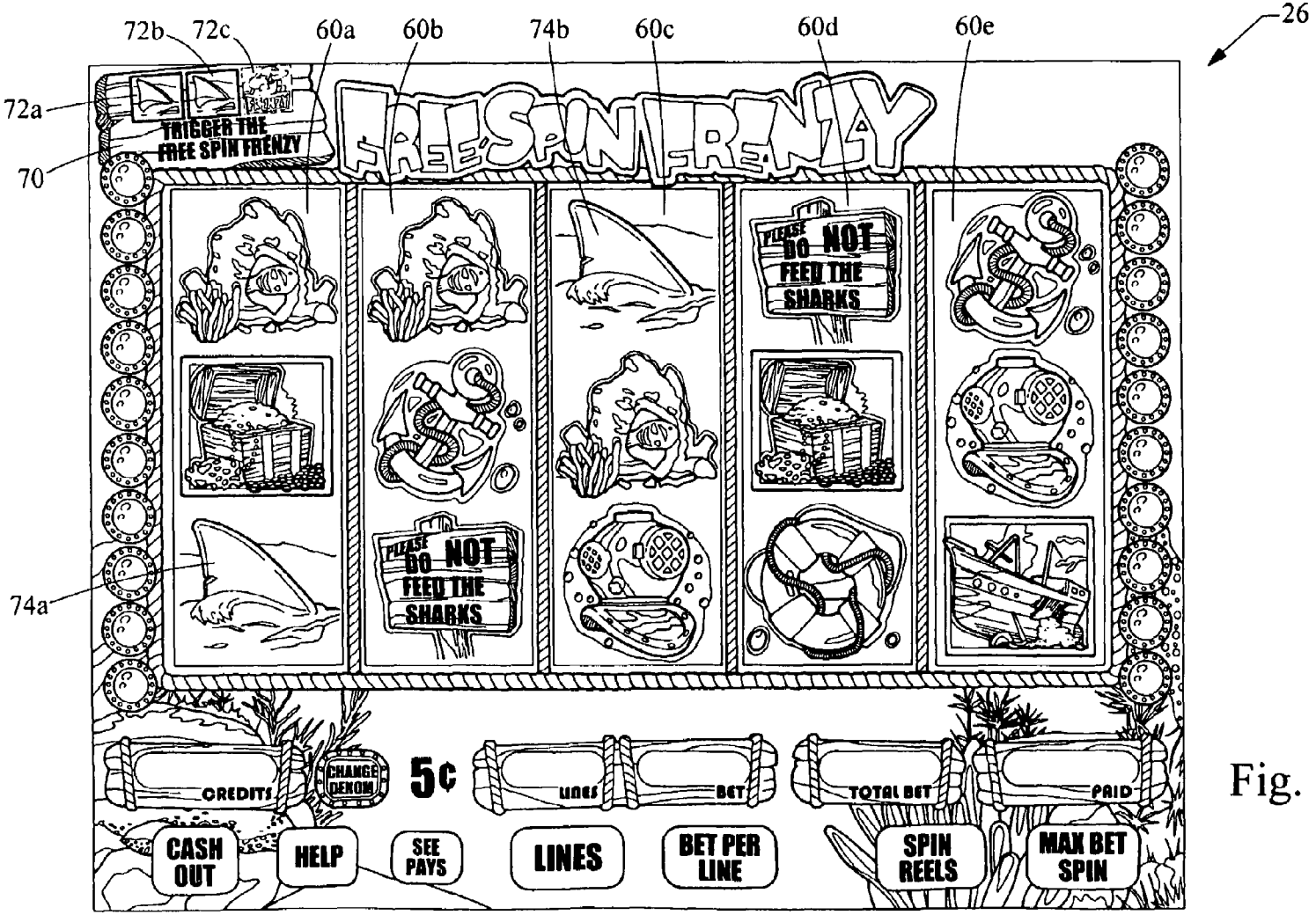
FIG. 8 illustrates the basic game screen of FIG. 3 showing all of the reels stopped.

Referring now to FIGS. 6 and 7, the last two reels 60*d*, 60*e* are shown stopped consecutively. No additional advantageous symbols have landed anywhere on the remaining reels 60*d*, 60*e*. Although the player may be disappointed because an advantageous outcome has not been reached, the meter 70 has caused the player to have a more exhilarating game-play experience. When the game ends, the meter 70 can be reset so that none of the meter symbols 72 are emphasized. Alternatively, the already emphasized meter symbols 72 can remain emphasized until the gaming session ends. In another embodiment, the meter symbols 72 that have already been emphasized remain emphasized until the player is awarded an advantageous outcome.

Figure 9:
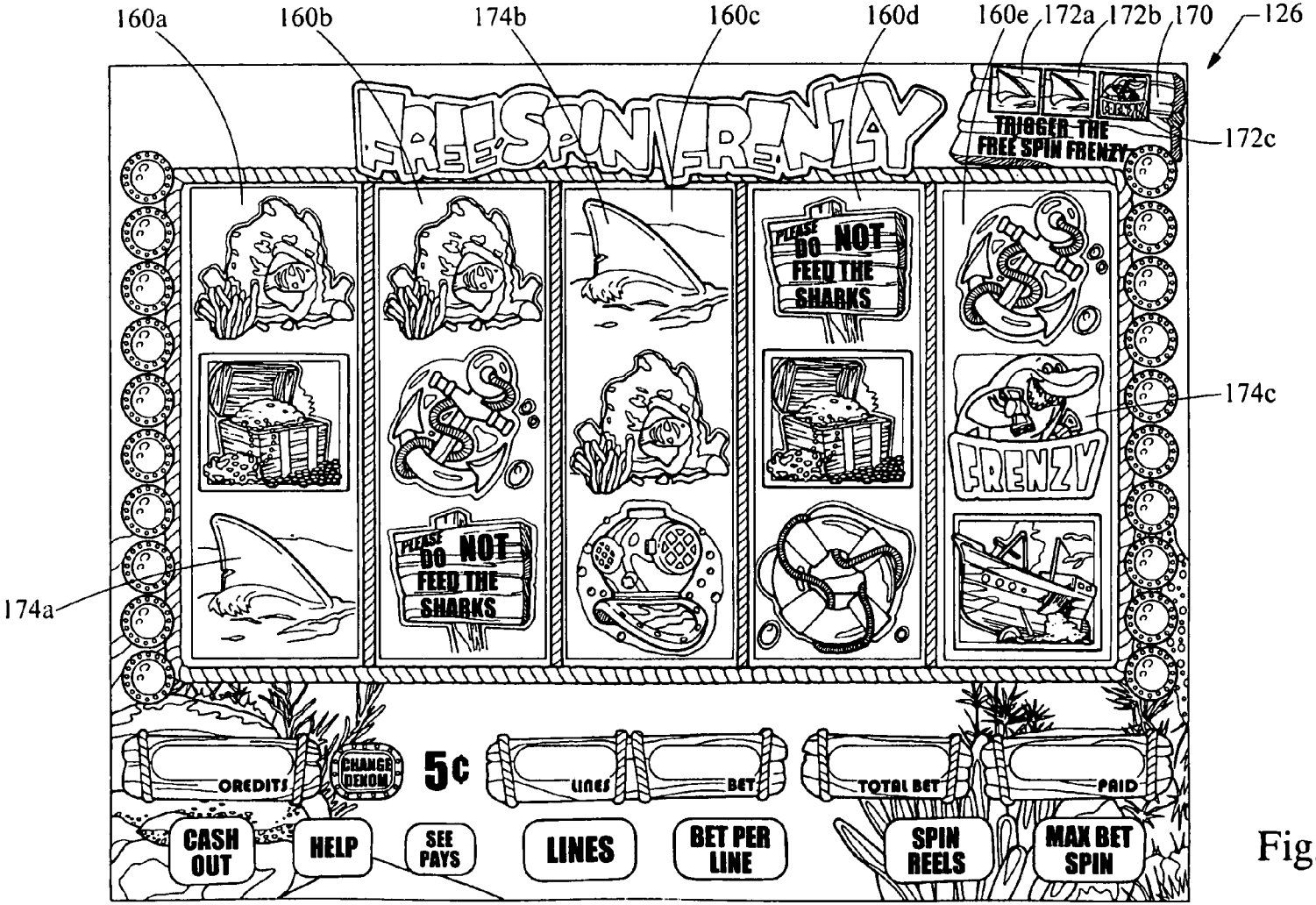
FIG. 9 illustrates a basic game screen with a meter, according to another embodiment of the present invention.

Referring now to FIG. 9, in an alternative embodiment of the present invention a main display 126 includes a plurality of reels 160*a*-160*e* and a meter 170. The meter 170 is located above the rightmost reel 160*e* and includes three meter symbols 172*a*-172*c*. The reels 160 have stopped spinning and three advantageous symbols 174*a*-174*c* have landed in the reels 160. A shark fin 174*a* has landed in the bottom position of the leftmost reel 160*a*, another shark fin 174*b* has landed in the top position of the center reel 160*c*, and a "Frenzy" shark 174*c* has landed in the central position of the rightmost reel 160*e*. The meter symbols 172*a*-172*c* are each shown emphasized. Thus, the player has won an advantageous outcome.

Figure 10:
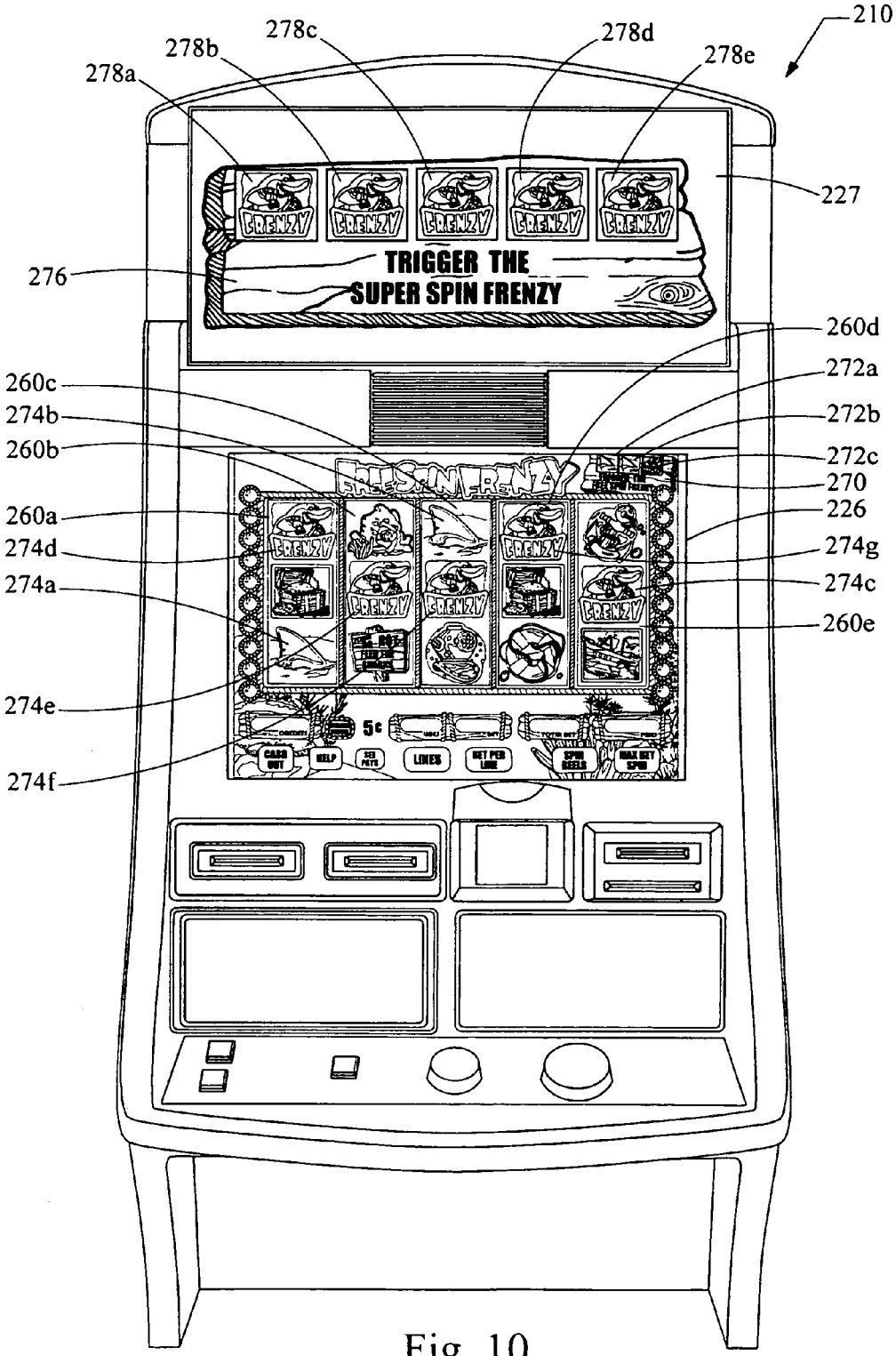
FIG. 10 illustrates a gaming terminal having a number of meters, according to another embodiment of the present invention.

Referring now to FIG. 10, in another alternative embodiment of the present invention a gaming terminal 210 has a main display 226 and a secondary display 227. The main display 226 includes a plurality of reels 260*a*-260*e* and a meter 270, which has three meter symbols 272*a*-272*c*. The reels are shown in a stopped position and include a plurality of advantageous symbols 274*a*-274*g*. The secondary display 227 includes a secondary meter 276, which includes five secondary meter symbols 278*a*-278*e*.

The meter 270 indicates to a player that two shark fin symbols and a shark "Frenzy" symbol are required to win a primary bonus outcome. Generally, this can be a bonus round or a bonus prize. The advantageous symbols 274*a*-274*g* include a "Frenzy" shark 274*d* in the top position of the leftmost reel 260*a*, a shark fin 274*a* in the bottom position of the leftmost reel 260*a*, and another shark fin 274*b* in the top position of the center reel 260*c*. Thus, the meter symbols 272*a*, 272*c* are emphasized when the leftmost reel 260*a* has stopped because two of the required advantageous symbols 274*a* and 274*d* have landed in the top and bottom positions of the reel 260*a*. The player only needs another shark fin advantageous symbol to reach the advantageous outcome. When the center reel 260*c* has stopped, the winning combination is indicated as being complete by having all three meter symbols 272*a*-27*c* shown in the emphasis mode.

Additionally, the player can play for a secondary bonus outcome, simultaneously with or in addition to the primary bonus outcome, such as a progressive game that is indicated by the secondary meter 276. If five shark "Frenzy" symbols are selected, the player wins a "Super Spin Frenzy" outcome. As shown in FIG. 10, five shark "Frenzy" symbols 274*c*-274*g* have been selected. Accordingly, the counterpart secondary meter symbols 278*a*-278*e* are emphasized. Thus, the player has triggered both a "Free Spin Frenzy" and a "Super Spin Frenzy," which may entitle the player to a plurality of free spins and other rewards.

The above-described embodiments can be used with a video gaming terminal and/or with a mechanical gaming terminal. For example, the reels 60 can be video reels, mechanical reels, or a combination of video and mechanical reels. Thus, although the description refers to reels 60 being "moving" or being "stopped," this does not necessarily imply that the reels 60 are mechanical reels. From a player's perspective, if the reels 60 are video reels, the reels 60 can "move" or "stop" even though the reels 60 do not physically "move" or "stop."

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A gaming terminal for playing a wagering game, comprising:

a display for displaying a randomly selected outcome in the form of an arrangement of symbols presented on a plurality of spinning reels, the randomly selected outcome being selected from a plurality of outcomes;

a meter having a plurality of meter symbols, the meter being displayed distinct from the symbols of the arrangement of symbols; and a controller coupled to the display and programmed to present on the plurality of reels the arrangement of symbols, at least one of the symbols being an advantageous symbol, and emphasize a corresponding meter symbol of the plurality of meter symbols when the advantageous symbol has been displayed on a stopped reel of the plurality of reels, the corresponding meter symbol being emphasized prior to stopping a next sequential reel of the plurality of reels.

2. The gaming terminal of claim 1, wherein the meter is located on a region of the display.

3. The gaming terminal of claim 1, further comprising a secondary display, wherein the meter is located on the secondary display.

4. The gaming terminal of claim 1, wherein the display is a mechanical display having at least one mechanical reel.

5. The gaming terminal of claim 1, wherein the controller is further programmed to emphasize the corresponding meter symbol using at least one feature selected from a group including illumination, animation, and coloration.

6. The gaming terminal of claim 1, wherein the meter includes at least three meter symbols.

7. The gaming terminal of claim 1, wherein the meter includes a plurality of meter symbols and the arrangement of symbols includes a plurality of advantageous symbols, each one of the plurality of meter symbols corresponding to one of the advantageous symbols.

8. The gaming terminal of claim 1, wherein the controller is further programmed to display the meter for a first bonus game and a different meter for a second bonus game.

9. The gaming terminal of claim 8, wherein the first bonus game is a top jackpot game and the second bonus game is a progressive game.

10. A method of conducting a wagering game, comprising:

using a wager input device on a gaming terminal to receive a wager input for conducting a wagering game;

in response to the wager input, using one or more processors to execute at least one game program to perform a random selection of a randomly-selected outcome selected from a plurality of outcomes;

displaying on a main display a symbol array on a plurality of spinning reels, the symbol array corresponding to the randomly-selected outcome and including an advantageous symbol;

using the display to display a meter having a plurality of meter symbols; and in response to displaying the advantageous symbol on a stopped reel of the spinning reels and prior to stopping a next sequential reel of the spinning reels emphasizing a corresponding meter symbol within the meter.

11. The method of claim 10, further comprising displaying the meter on a region of the main display.

12. The method of claim 10, further comprising displaying the meter on a secondary display.

13. The method of claim 10, further comprising selecting the winning outcome from a group consisting of a bonus-award outcome, a credit-award outcome, a progressive-award outcome, and a top-award outcome.

14. The method of claim 10, wherein the emphasizing includes modifying the corresponding meter symbol using at least one action selected from the group including illumination, animation, color changing, and shape changing.

15. The method of claim 10, wherein the emphasizing includes changing the pace of the emphasizing to heighten a player's anticipation.

16. The method of claim 10, wherein the controller is located within the gaming terminal.

17. The method of claim 10, further comprising locating the meter in a region above the symbol array.

18. The method of claim 10, further comprising displaying on a secondary display a secondary meter.

19. A method of conducting a wagering game, comprising:

using a wager input device on a gaming terminal to receive a wager input for conducting a wagering game;

in response to the wager input, using one or more processors to execute at least one game program to perform a random selection of a randomly-selected outcome selected from a plurality of outcomes;

using at least one of the processors to rotate a plurality of symbol-bearing reels;

using at least one of the processors to stop one of the symbol-bearing reels with an advantageous symbol aligned along an active payline for indicating a randomly-selected outcome to a player, the randomly-selected outcome being selected from a plurality of outcomes; and in response to displaying the advantageous symbol on a display of the gaming terminal, using at least one of the processors to emphasize a meter symbol of a meter before stopping a next sequential reel of the symbol-bearing reels, the meter being located in a region separate from the symbol-bearing reels.

* * * * *

UNITED STATES PATENT AND TRADEMARK OFFICE

CERTIFICATE OF CORRECTION

PATENT NO. : 7,628,693 B2
APPLICATION NO. : 11/186472
DATED : December 8, 2009
INVENTOR(S) : Alfred Thomas It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 754 days.

Signed and Sealed this

Second Day of November, 2010

David J. Kappos

David J. Kappos
*Director of the United States Patent and Trademark Office*